US006236713B1

(12) United States Patent
True et al.

(10) Patent No.: US 6,236,713 B1
(45) **Date of Patent: *May 22, 2001**

(54) X-RAY TUBE PROVIDING VARIABLE IMAGING SPOT SIZE

(75) Inventors: Richard B. True, Sunnyvale; James C. Taylor, Redwood City; Christopher P. Ferrari, San Carlos; Curtis G. Allen, Hayward, all of CA (US); Thomas M. Bemis, Montoursville, PA (US)

(73) Assignee: Litton Systems, Inc., Woodland Hills, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/179,805

(22) Filed: Oct. 27, 1998

(51) Int. Cl.[7] ..... H01J 35/14
(52) U.S. Cl. ..... 378/138; 378/136; 378/137
(58) Field of Search ..... 378/119, 121, 378/136, 137, 138, 140, 143, 144, 113

(56) References Cited

U.S. PATENT DOCUMENTS

| | | | | |
|---|---|---|---|---|
| 2,011,540 | | 8/1935 | Lee . | |
| 2,683,223 | | 7/1954 | Hosemann . | |
| 3,732,426 | | 5/1973 | Shimizu . | |
| 4,566,116 | * | 1/1986 | Nakano et al. | 378/121 |
| 4,618,977 | | 10/1986 | Brettschneider et al. . | |
| 4,689,809 | * | 8/1987 | Sohval | 378/136 |

(List continued on next page.)

FOREIGN PATENT DOCUMENTS

| | | |
|---|---|---|
| 0 150 364 | 8/1985 | (EP) . |
| 0 168 776 | 1/1986 | (EP) . |
| 0 389 326 | 9/1990 | (EP) . |
| 2 333 344 | 6/1977 | (FR) . |
| 247568 | 9/1926 | (GB) . |
| 460181 | 1/1937 | (GB) . |
| 1 444 109 | 7/1976 | (GB) . |
| WO 98/13853 | 4/1998 | (GB) . |

(List continued on next page.)

*Primary Examiner*—David P. Porta
(74) *Attorney, Agent, or Firm*—O'Melveny & Myers LLP

(57) ABSTRACT

A variable spot size x-ray tube comprises a cathode having an electron emitting surface providing an electron beam that travels essentially along the tube axis of symmetry to an anode. The anode, spaced from the cathode, includes a target, the front surface of which is disposed at an oblique angle with respect to the axis of symmetry. The potential of the anode is generally positive with respect to that of the cathode. The cathode is heated to a temperature at which electrons are emitted by the thermionic emission process. Current from the cathode can be controlled by varying the cathode temperature if the cathode is operated in the temperature limited region. The incident electron beam forms a spot on the target surface whereupon x-rays are produced in response to impingement of the electron beam on the target. The x-rays propagate outwardly from the target spot through a vacuum window to form a beam of x-radiation outside the x-ray tube. An aperture grid is disposed between the cathode and the anode, and has a central aperture permitting the electron beam to pass therethrough. The aperture grid further has a variable voltage applied to it which may be positive, negative, or equal to the potential of the cathode. The voltage on the control grid is used to control the diameter of the electron beam which impinges upon the target. Specifically, the electron beam diameter varies in correspondence with the variable aperture grid voltage, and selective variation of the electron beam diameter results in a corresponding variation in size of the x-ray imaging spot.

23 Claims, 7 Drawing Sheets

U.S. PATENT DOCUMENTS

| | | | | |
|---|---|---|---|---|
| 4,731,804 | | 3/1988 | Jenkins . | |
| 4,979,199 | | 12/1990 | Cueman et al. . | |
| 4,993,055 | | 2/1991 | Rand et al. . | |
| 5,128,977 | * | 7/1992 | Danos | 378/121 |
| 5,367,553 | | 11/1994 | d'Achard Van Enschut et al. . | |
| 5,703,924 | * | 12/1997 | Hell et al. | 378/136 |
| 5,822,395 | * | 10/1998 | Schardt et al. | 378/137 |

FOREIGN PATENT DOCUMENTS

| | | | | |
|---|---|---|---|---|
| 59-94348 | * | 5/1984 | (JP) | 378/138 |
| 6-13195 | * | 1/1994 | (JP) | 378/138 |
| 458899 | * | 1/1979 | (SU) | 378/138 |
| WO 97/42646 | | 11/1997 | (WO) . | |

* cited by examiner

FIG. 3
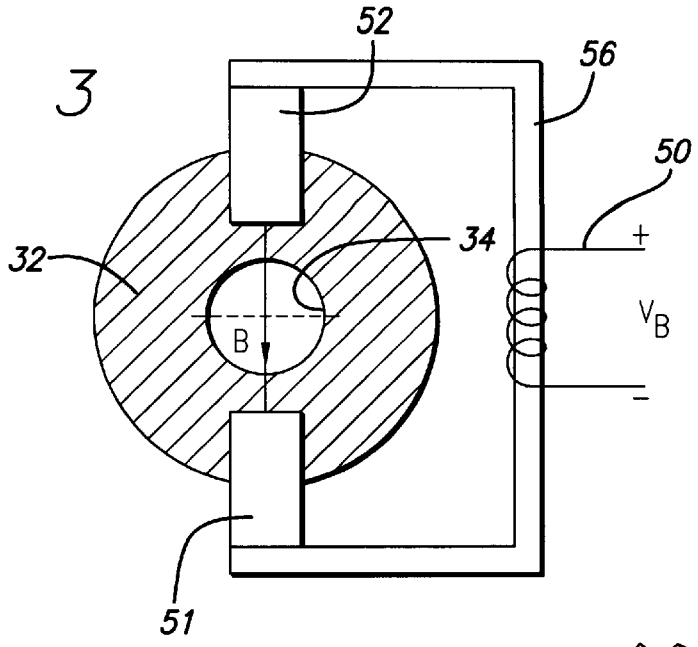
FIG. 4
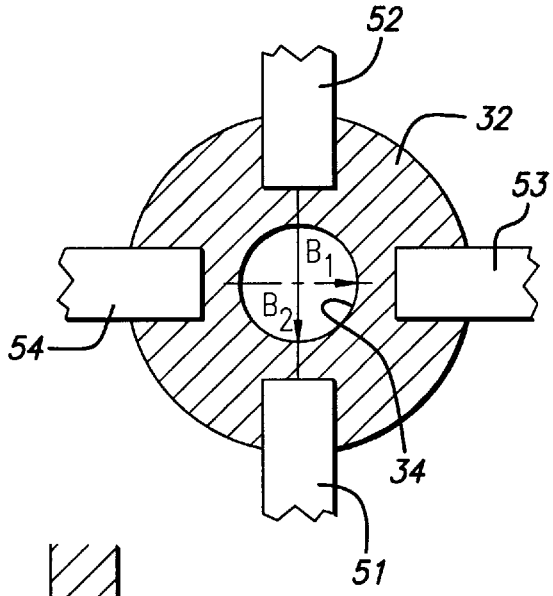
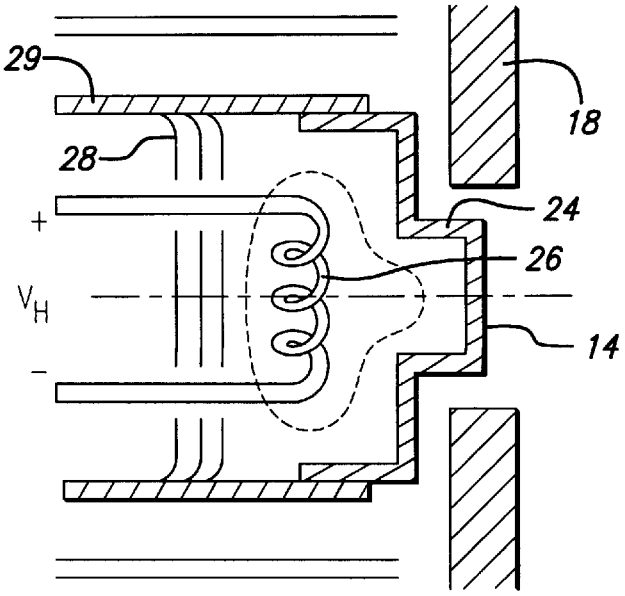
FIG. 5

X-RAY TUBE PROVIDING VARIABLE IMAGING SPOT SIZE

BACKGROUND OF THE INVENTION

1. Field of the Invention

The present invention relates to x-ray tubes, and more particularly, to a high power x-ray tube that produces an imaging spot size that is continuously adjustable over a given range.

2. Description of Related Art

It is well known in the art to use a source of x-rays to produce planar images for medical and technical diagnostic applications. In the field of technical diagnostic imaging, x-rays are especially effective at penetrating internal structures of a solid imaging object, and the images formed by the x-rays that pass therethrough reveal internal flaws or structural defects of the object. Technical diagnostic x-ray imaging thus provides a valuable quality control inspection tool for evaluating structural aspects of a product during manufacture and over the useful life of the product. This form of diagnostic analysis is advantageous over other types of evaluation, since the imaging object need not be destroyed in the process of the evaluation. For this reason, technical diagnostic imaging is also known as non-destructive testing.

A x-ray tube for technical imaging applications typically comprises an electron gun having a cathode that is excited to emit a beam of electrons that are accelerated to an anode. The anode may be comprised of a metal target surface, such as tungsten, from which x-rays are generated due to the impact of the accelerated electrons. By disposing the anode surface at an angle to the axis of the electron beam, the x-rays may be transmitted in a direction generally perpendicular to the electron beam axis. The x-rays may then be passed through a beryllium window used to provide a vacuum seal within the x-ray tube. Thereafter, the x-rays exit the x-ray tube along a generally conical path where the apex of the cone is roughly coincident with the spot on target formed by the impinging electron beam.

The amount of magnification provided by an x-ray tube is dependent, in part, upon the spot size, which is sometimes referred to as the imaging spot size. A smaller spot size typically enables greater magnification while maintaining desirable image sharpness, but covers a smaller portion of the imaged object. This is accomplished, for example, by situating the imaged object closer to the x-ray source, that is the x-ray imaging spot, with respect to the position of the photographic film or other x-ray image recording means. Conversely, a larger spot size can image a greater portion of the imaged object, but typically at a lower magnification level. In this case, in contrast to the smaller spot size, the area of electron beam impingement is larger on target; hence, a higher voltage, higher current, or higher voltage and current electron beam can be utilized without thermally overstressing the target. Conventional x-ray tubes are typically limited to providing either a single spot size, or in some cases, two discrete spot sizes. To provide two different spot sizes, the x-ray tubes have two distinct cathode filaments that are alternatively energized to provide electron beams of different diameters. An operator of an x-ray tube will select one of the cathode filaments depending upon the desired magnification level and size of the imaging object. A drawback of such systems is that the spot size of the x-ray tube cannot be optimized for a particular imaging operation.

In conventional x-ray tubes, another approach to reducing the effective spot size is to position the anode surface at an angle flatter than 45° to the beam axis while maintaining the x-ray output cone oriented at 90° to the beam axis. An advantage of this approach is that the flat anode angle lowers the power density on the anode, which, if excessive, can cause undesirable melting and vaporization of the tungsten target material. Moreover, to geometrically compensate for the flat anode angle, the electron gun is configured to provide an elliptical electron beam so that the x-ray spot will have a circular cross-section. This lack of axial symmetry of the electron gun can add cost and complexity to the manufacture of the x-ray tube. Further, the electron beam spot is rarely elliptical, and the resultant x-ray imaging spot is usually distorted in shape, has intensity irregularities, and is non-circular leading to inferior quality x-ray images.

Thus, it would be desirable to provide an x-ray tube having a spot size that is continuously adjustable over a given range to allow greater flexibility in the imaging operations. It would also be desirable to provide an x-ray tube constructed with an axially symmetric geometry to simplify manufacture and improve the symmetry and intensity of the x-ray spot. A further desirable advantage is that the spot size and x-ray intensity can be varied without repositioning the object. Finally, it would be desirable to provide an x-ray tube having a more uniform intensity circular x-ray imaging spot for improved quality x-ray images.

SUMMARY OF THE INVENTION

In accordance with the teachings of the present invention, an x-ray tube produces a continuously adjustable spot size over a given range. The continuously adjustable spot size enables an operator to select an optimum spot size and intensity for imaging a particular imaging object. In addition, the x-ray tube has an axially symmetric geometry leading to simpler mechanical fabrication, and a substantially more uniform intensity circular x-ray imaging spot for improved quality x-ray images.

More particularly, the x-ray tube comprises a cathode having an electron emitting surface providing an electron beam that travels along an axis of symmetry of the electron emitting surface. An anode is spaced from the cathode and has a target surface disposed at an angle of 157.5° with respect to the axis of symmetry. The target surface provides x-rays in response to impingement of the electron beam thereon. The x-rays are directed outwardly of the x-ray tube from an x-ray imaging spot on the x-ray target. An aperture grid is disposed between the cathode and the anode, and has a central aperture permitting the electron beam to pass therethrough. The aperture grid further has a variable voltage applied thereto with respect to the cathode, which is used to control a diameter of the electron beam. Specifically, the electron beam diameter varies in correspondence with the variable voltage, and selective variation of the electron beam diameter results in a corresponding variation in size of the x-ray imaging spot.

In an embodiment of the invention, the x-ray tube is adapted to alter a position of the electron beam with respect to the axis of symmetry to thereby alter a point of impingement of the electron beam on the target surface. At least one magnetic polepiece is disposed within the anode in a direction perpendicular to the axis of symmetry. A magnetic field is applied to the polepiece so that the magnetic field crosses through the electron beam. This way, the electron beam is caused to impinge upon a separate spot on the target surface in order to distribute the deleterious effects of thermal stress on the target surface.

A more complete understanding of the variable spot x-ray tube will be afforded to those skilled in the art, as well as a realization of additional advantages and objects thereof, by a consideration of the following detailed description of the preferred embodiment. Reference will be made to the appended sheets of drawings which will first be described briefly.

BRIEF DESCRIPTION OF THE DRAWINGS

FIG. 3 is an end view of an embodiment of an anode of the electron gun having a single-axis magnetic polepiece for altering the electron beam position;

FIG. 4 is an end view of an embodiment of an anode of the electron gun having a double-axis magnetic polepiece for altering the electron beam position;

FIG. 5 is a side sectional view of an alternative embodiment of a cathode assembly of the electron gun;

DETAILED DESCRIPTION OF THE PREFERRED EMBODIMENT

The present invention satisfies the need for an x-ray tube having a spot size that is continuously adjustable over a given range to allow greater flexibility in the imaging operations. In the detailed description that follows, it should be appreciated that like element numerals are used to describe like elements illustrated in one or more of the above-described figures.

Figure 1:
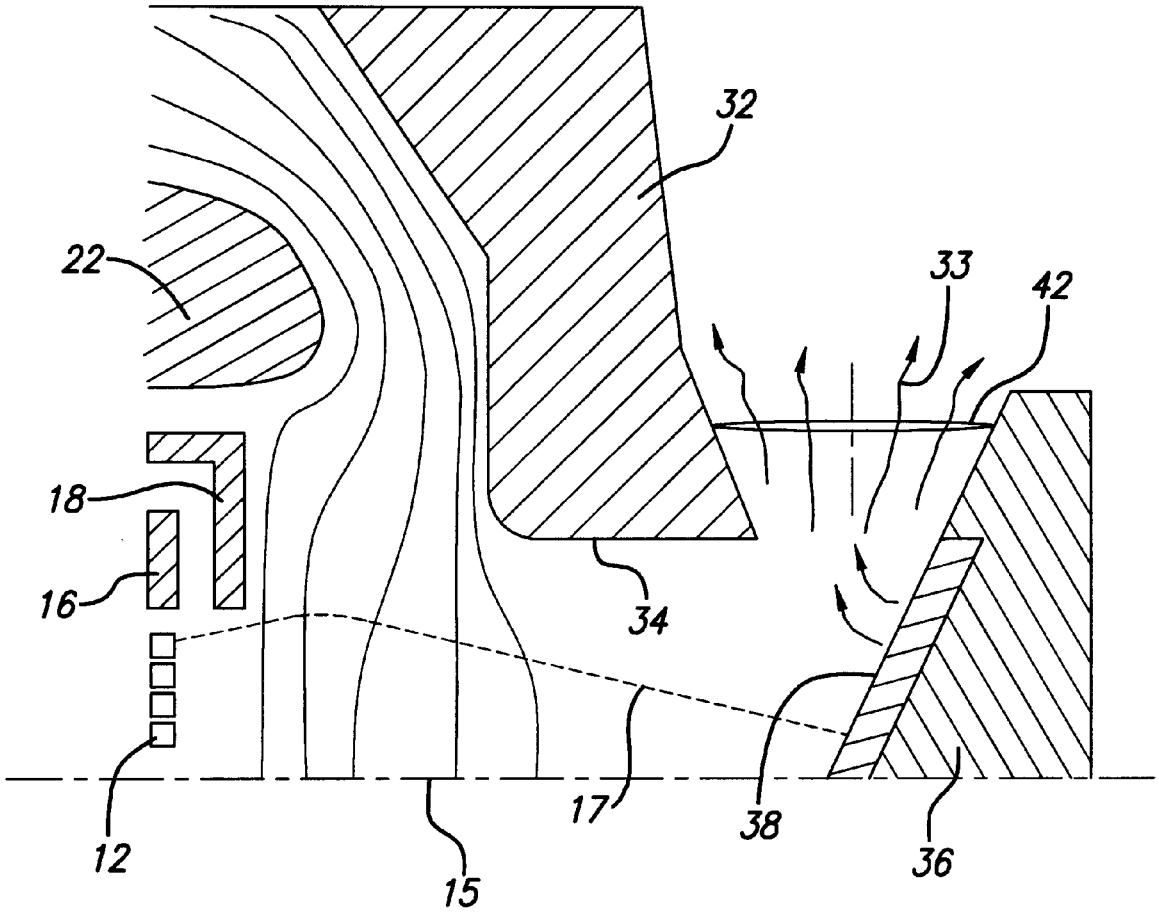
FIG. 1 is a side sectional view of an electron gun for an x-ray tube of the present invention.

Referring first to FIG. 1, a first embodiment of an electron gun for use in an x-ray tube is illustrated. The electron gun includes a cathode assembly having an electron emitter 12. The emitter 12 may be comprised of a helically coiled filamentary wire formed from thoriated tungsten or other similar electron emissive materials, and is disposed such that it occupies a generally circular or symmetrical space. The filamentary wire may have a generally flat cross-section of the type commonly referred to as "pancake." An edge electrode 16 having an annular shape is disposed concentrically around and spaced from the emitter 12, and an annular focus electrode 22 is disposed concentrically around and spaced from the edge electrode.

An aperture grid 18 is disposed concentrically between the edge electrode 16 and the focus electrode 22. The aperture grid 18 is also annular shaped and has a central opening through which the emitter 12 is exposed. As shown in FIG. 1, the aperture grid 18 has a flat surface that lies in a plane parallel to the emitter 12. The emitter 12, the edge electrode 16, and the focus electrode 22 are commonly coupled to the same negative electric potential, and the aperture grid 18 is coupled to a variable positive or negative voltage source with respect to these cathode elements. Moreover, the emitter 12, the edge electrode 16, the aperture grid 18, and the focus electrode 22 are each symmetrically disposed about a common axis 15.

An anode assembly is spaced from the cathode assembly. The anode assembly includes an annular portion 32 and a target portion 36. The annular portion 32 includes an opening 34 that extends along the axis 15. The target portion 36 comprises a target surface 38 that is disposed at an obtuse angle with respect to the axis 15, and which is not symmetrical with the axis. The target surface 38 is comprised of an x-ray emissive material, such as tungsten. A conically shaped opening is provided between the annular portion 32 and the target portion 36 which provides an output passage for x-rays generated within the device, as will be further described below. A window 42 crosses the conically shaped opening to maintain a vacuum seal within the device. The window 42 may be comprised of beryllium or similar materials selected to permit transmission of x-rays therethrough.

In operation, an electric current is applied to the emitter 12 which causes its temperature to rise to a level sufficient to permit thermionic emission of electrons to occur. A highly negative voltage is applied to the cathode assembly with respect to the anode assembly, such as −160 kilovolts, so that a beam of electrons is drawn from the emitter 12 toward the anode assembly. Conversely, the cathode assembly may be grounded and a highly positive voltage, e.g., +160 kilovolts, may be applied to the anode assembly. As known in the art, the current of the electron beam is dependent upon the temperature of the emitter 12 when it is operated in the temperature limited region. The shape of the edge electrode 16 and the focus electrode 22 are selected to define a pattern of equipotential lines in the interelectrode space between the cathode assembly and the anode assembly such that the electron beam is generally focussed and directed towards the target surface 38.

An outer envelope 17 of the electron beam is illustrated in FIG. 1. The electron beam passes through the opening 34 of the annular portion of the anode 32, and impinges upon the target surface 38 to produce x-rays 33. The x-rays 33 transmit in a generally conical path through the opening provided between the annular portion 32 and the target portion 36 of the anode assembly. The x-rays 33 pass through the window 42 to form an imaging spot at a predetermined distance beyond the device. The voltage provided to the aperture grid 18 causes the electron beam to diverge or compress as the electron beam leaves the emitter 12. After passing the aperture grid 18, the electron beam expands to a generally diverging path whence it is subsequently focussed into a cone by the shape of the electrostatic fields between the aperture grid 18 and the anode assembly.

Figure 2:
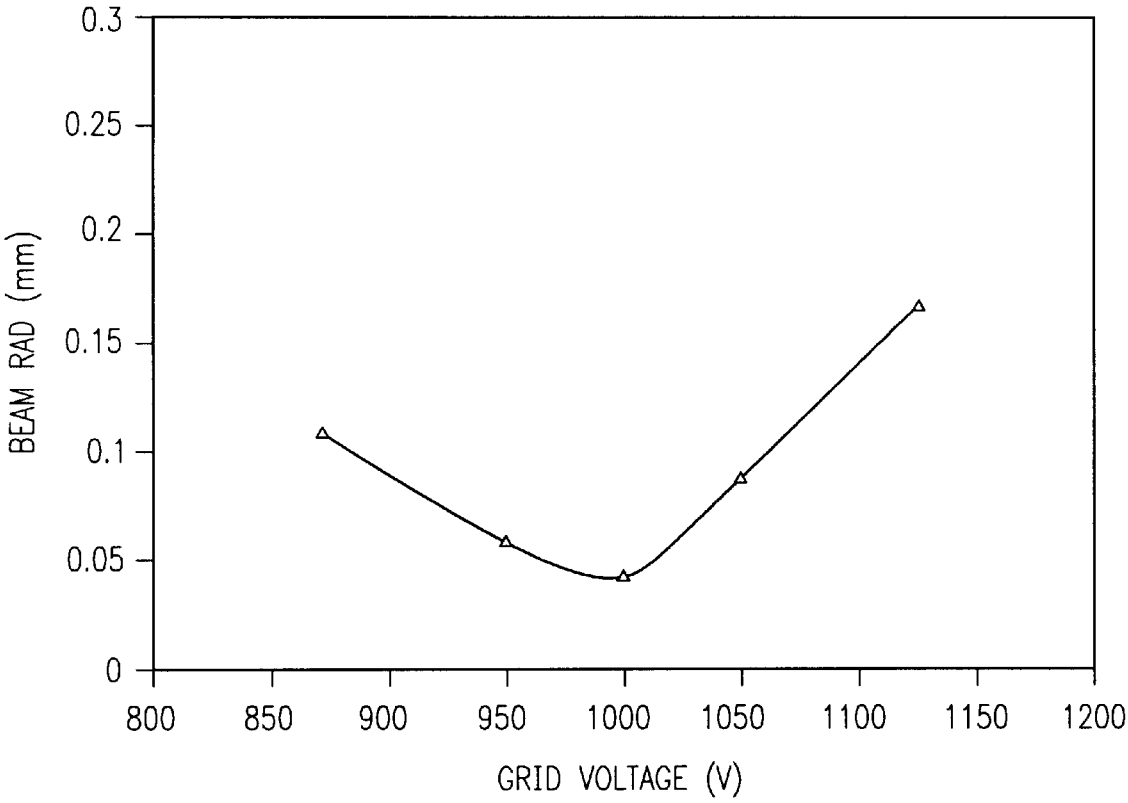
FIG. 2 is a computer simulation approximation graph of the x-ray tube variable imaging spot size performance for beam radius as a function of aperture grid voltage.

As a specific example, FIG. 2 provides a chart derived from a computer simulation approximation of the x-ray tube variable imaging control. The chart shows a plot of beam radius in millimeters (y axis) versus the aperture grid voltage (x axis) where the beam radius is defined as the radius enclosing 63.2 percent of the electron beam. Assuming +160 kilovolts has been applied to the anode assembly, the graph shows that minimization of the spot size on target occurs when the aperture grid voltage is set to approximately +990 volts with respect to the cathode assembly at 0 volts. Accordingly, the diameter of the electron beam at the point of impact on the target surface 38 may be modified by varying the voltage applied to the aperture grid 18. For example, the size of the beam may be effectively doubled by applying a voltage of +910 volts to the aperture grid, or alternately +1,045 volts.

Furthermore, it is possible to switch all beam current off by application of a generally negative voltage to the aperture grid 18 with respect to the cathode assembly. By varying the focusing of the electron beam, the spot size of the generated x-rays also changes. This way, the imaging spot size provided by the x-ray device increases as the diameter of the electron beam striking the target surface 38 increases, and decreases as the diameter of the electron beam decreases. This relationship between the shape of the electron beam and the x-ray spot size will be further described below in the discussion of the geometry of the present and prior art devices.

Referring next to FIGS. 3 and 4, alternative embodiments of the electron gun of an x-ray tube are shown. These embodiments are directed to solving a problem of overstressing the target surface of the anode. As noted above, a drawback of conventional x-ray tubes is that the power density of the electron beam striking the anode can cause undesirable melting and vaporization of the tungsten material. One way to avoid the overstressing of the target surface is to move the impact point of the electron beam to different locations. This must be achieved without distorting the shape of the electron beam, so that the power density of the x-ray imaging spot is not degraded.

More particularly, FIG. 3 illustrates the annular portion 32 of the anode assembly in cross-section. A polepiece having first and second sections 51, 52 extend in a radial direction into the annular portion 32 of the anode assembly. The polepiece sections 51, 52 do not extend entirely to the opening 34, but terminate before reaching the opening to ensure that the vacuum envelope of the x-ray tube is not affected by the introduction of the polepiece sections. The polepiece sections 51, 52 are further coupled to a magnetic return strap 56 having an inductive coil 50 connected thereto. Application of an electric current to the inductive coil 50 produces a magnetic field B that bisects the opening 34 and extends perpendicularly with the central axis 15 of the electron gun. By varying the level of the electric current applied to the inductive coil 50, the magnitude of the magnetic field B can be altered. The magnetic field B will deflect the electron beam as it is projected through the opening 34, causing the electron beam to strike an alternative location of the target surface 38. In this manner, the electron beam may be periodically repositioned to spread the energy of the electron beam across a greater area of the target surface 38 to reduce the thermal stress to any one point. The deflection of the electron beam may be manually controlled by an operator of the x-ray tube, or alternatively, may be automatically controlled upon detection of any overheating of the target surface 38.

Similarly, FIG. 4 illustrates another embodiment in which a pair of crossed polepieces having sections 51, 52 and 53, 54 are utilized. The polepiece sections are disposed perpendicularly with respect to each other, and each have respective inductive coils (not shown) to provide magnetic fields $B_1$ and $B_2$ that extend in two axes through the central axis 15. It should be appreciated that the crossed magnetic fields $B_1$ and $B_2$ thus permit a greater range of control over deflection of the electron beam in the two axis directions.

In FIG. 5, an alternative embodiment of the cathode assembly is illustrated. In this alternative embodiment, the cathode assembly comprises a helically coiled filamentary wire 26 disposed within an oven region defined by a support sleeve 29 and a thermally sealed end cap 24. A central portion of the end cap 29 provides an emitting surface 14 comprised of thoriated tungsten or other similar electron emissive materials. The emitting surface 14 has circular shape that is disposed concentrically within and spaced from the aperture grid 18. Heat shields 28 may also be provided within the cathode assembly to contain heat within the oven region and preclude thermal transfer outside the oven region.

To operate the cathode assembly, a voltage potential $V_H$ is applied across the filamentary wire 26. As in the previous embodiment, the current conducted through the filamentary wire 26 causes its temperature to increase. The heat generated by the filamentary wire is radiated outwardly within the oven region (e.g., in a pattern illustrated with broken lines in FIG. 5), onto the end cap 24, and particularly, the emitting surface 14. The thermal radiation onto the emitting surface 14 causes thermionic emission of electrons to occur therefrom, and a beam of electrons may be drawn from the emitting surface 14 by application of a high negative voltage potential between the cathode assembly and the anode assembly. Furthermore, a potential difference can be applied between the filamentary wire 26 and the emitting surface 14. In this case, electrons from filamentary wire 26 bombard the rear of the end cap 24 heating it to a temperature sufficient for thermionic emission to occur. This general embodiment is advantageous since the emitting surface 14 can provide an electron beam having a more consistent and uniform current density and a more clearly defined outer envelope than a beam produced by direct emission from a filamentary wire.

Figure 6:
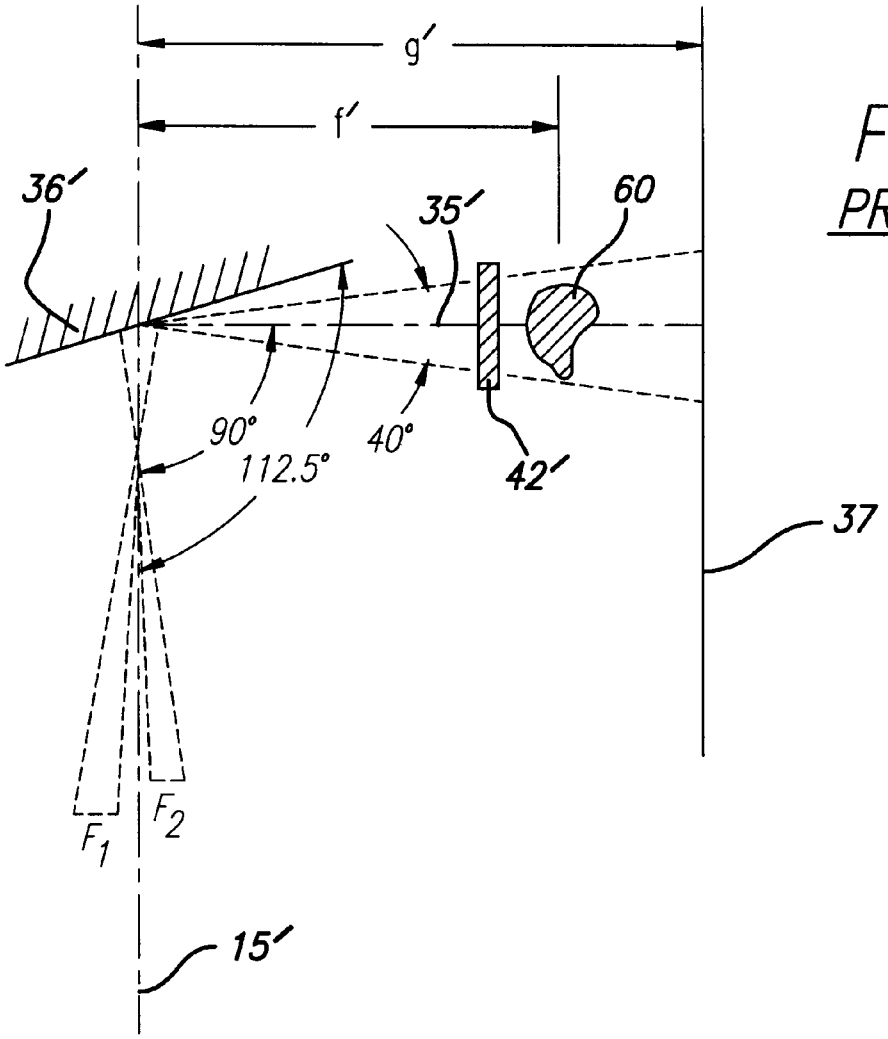
FIG. 6 PRIOR ART
FIG. 6 is a schematic view of an x-ray output cone provided by a prior art double-filament cathode.

In another aspect of the present invention, the target angle is selected to further enable a continuously variable spot size with an axially symmetric geometry. FIG. 6 illustrates, in schematic form, a prior art x-ray tube using a conventional 22.5° target angle between a central axis 35' of the x-ray output cone and the target surface 36' (target surface 36' is disposed at a 112.5° angle with respect to a central axis 15' of the x-ray tube). The prior art x-ray tube provides two dissimilar size spots on target. To accomplish this, the tube includes two cathode filaments, shown as $F_1$ and $F_2$, which occupy separate non-symmetrical regions of the electron emitter with respect to the central axis 15'. These filaments are typically wires wound in the form of helices, $F_1$ being generally longer in length and having a larger helical pitch than $F_2$. In view of the general dissimilarity between filaments $F_1$ and $F_2$ and their non-symmetrical placement, the respective electron beams can and generally do strike different locations on the target surface 36'. As noted above, the two filaments $F_1$ and $F_2$ are adapted to generate different diameter beams such that the beam produced by filament $F_1$ is larger than the beam produced by filament $F_2$.

Upon striking the target surface 36', the impinging beams produce x-ray output cones that pass through the window 42' to illuminate an object of interest 60 disposed a focal length f' from the target surface. For either beam, the roughly circular cross-sectional area x-ray spots at the target as viewed from the illuminated object constitute the imaging spot sizes for the x-ray tube. In general, the beam from the longer filament $F_1$ will produce a larger spot size of higher current on target, while the shorter filament $F_2$ will produce a smaller size spot of lower current on target. By situating the film or other x-ray image recording means 37' at a distance g' from the image spot, a magnified x-ray image results. In the prior art x-ray tube, the focal length f' is most likely less than or equal to 6 inches to permit sufficient intensity. A central axis 35' of the x-ray output cone forms a 90° angle to the central axis 15' of the x-ray tube. Thus, the x-ray tube emits an imaging spot in a generally perpendicular direction from the axis of the x-ray tube. The typical cone angle in tubes of this type is typically 40° as shown in FIG. 6.

Figure 7:
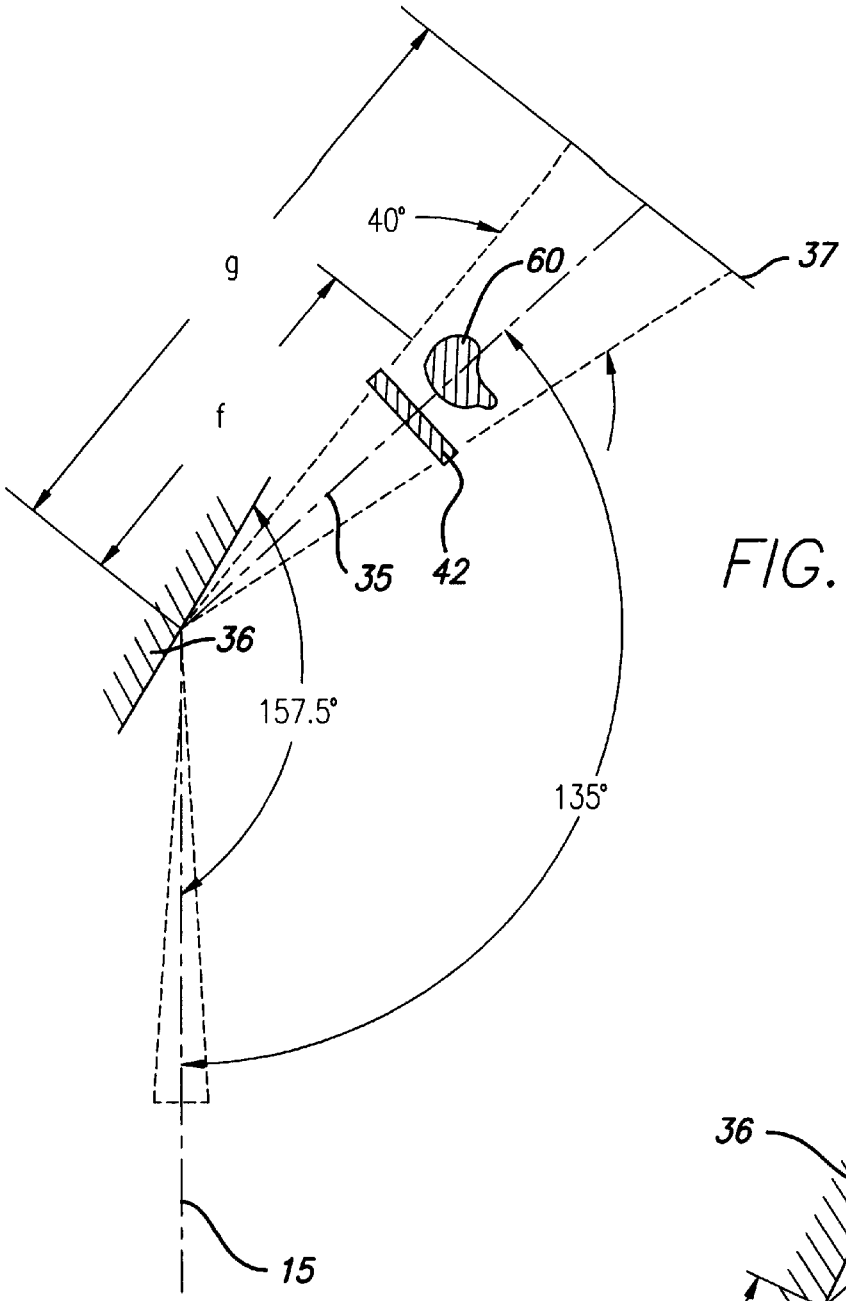
FIG. 7 is a schematic view of an x-ray output cone provided by a variable spot cathode of the present invention.

FIG. 7 illustrates a target angle in accordance with an embodiment of the present invention. Unlike the prior art x-ray tube, the target surface 36 is disposed at a 157.50° angle with respect to a central axis 15 of the x-ray tube. With the larger target angle, the central axis 35 of the x-ray output cone forms a 135° angle to the central axis 15 of the x-ray tube. Since the electron beam is axially symmetric about the central axis 15, the x-ray output cone similarly has symmetrical intensity to illuminate an imaging object 60 at a focal length f from the target surface. Higher magnification than the prior art x-ray tube can be obtained in the tube of the present invention since the object can be situated closer to the imaging focual spot, for example, as close as 1.2 inches. It should be appreciated that the enlarged target area of the present invention upon which the electron beam inpinges also results in lower heating per unit area of the target surface 36. Furthermore, situating the object closer to the imaging spot reduces the intensity required for a given degree of magnification and image brightness. The cone angle in a x-ray tube of this invention as shown in FIG. 7 is typically 40° like that of the prior art x-ray tube.

Figure 8:
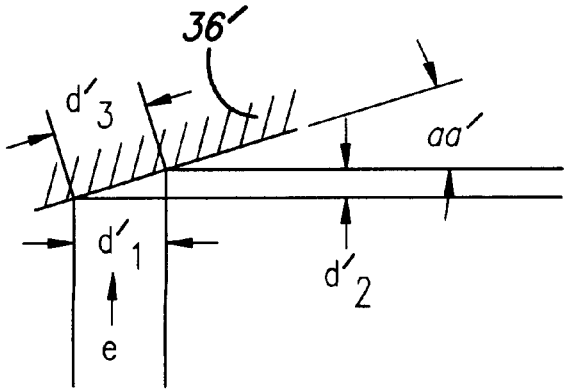
FIG. 8 PRIOR ART
FIG. 8 illustrates the geometric relationship between the x-ray output cone and the anode target angle for the prior art x-ray tube.

In FIG. 8, the geometric relationship between the apparant x-ray image spot and the incident electron beam onto the target for the prior art x-ray tube is illustrated. An electron beam e having a length in the direction of the filamentary cathodes $d_1'$ is projected onto a target surface 36' that is disposed at an angle aa' with respect to the axis of the outgoing x-ray beam. The beam of x-rays has a apparant spot length $d_2'$ equivalent to $d_1'$ tan aa' and the width of the impingement region $d_3'$ of the target surface 36 is equivalent to $d_2'$ /sin aa'. Therefore, the apparent spot size of the x-ray beam is smaller than the incident electron beam if the anode target angle aa' is less than 45°. For the case of aa'=22.5° target angle used in the prior art device, the reflected beam will be 41% smaller than the incident beam length. In the direction parallel to the helical filament windings $F_1$ and $F_2$, there is no reduction in the apparent size of the x-ray beam spot size over the size of the electron beam inpinging on the target surface since the target surface is not inclined in this direction. For a given spot length of the apparent x-ray beam size $d_2'$, it can be appreciated that inclining the target at an angle is a means of reducing electron beam power density on target surface for a given x-ray beam spot size. For the case of aa'=22.5°, the length of target surface upon which the beam strikes is 2.6 times longer than the length of the apparant x-ray beam spot size.

Figure 9:
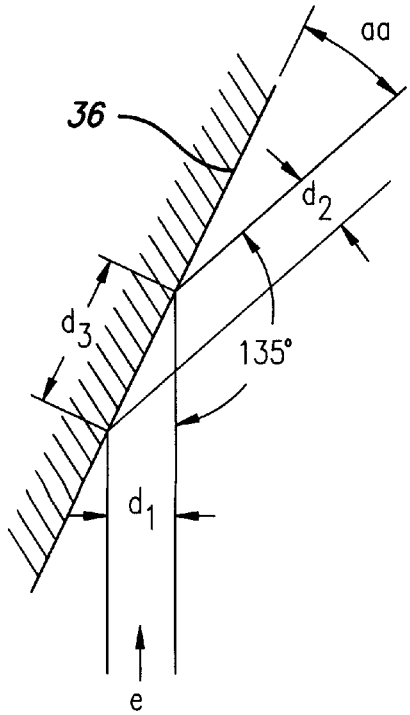
FIG. 9 illustrates the geometric relationship between the x-ray output cone and the anode target angle in accordance with the present invention.

In contrast, FIG. 9 shows the geometric relationship between the x-ray output cone and the anode target angle for the x-ray tube of the present invention. As described above, the x-ray tube of the present invention has an anode target angle aa of 22.5° with respect to the x-ray cone axis, and an x-ray beam angle of 135° with respect to the angle of the axis of the incident electron beam. Accordingly, the extent of the target surface upon which the electron beam e impinges, $d_3$, is $d_2$/sin aa. Since the angle of the electron beam incidence equals the angle of the outgoing x-ray beam, it follows that $d_2$ is equal to $d_1$. Thus, for the case of aa =22.5° in the tube of the present invention, the length of target upon which the beam strikes is 2.6 times longer than the length of the apparant x-ray beam spot size like that in the prior art x-ray tube.

Figure 10:
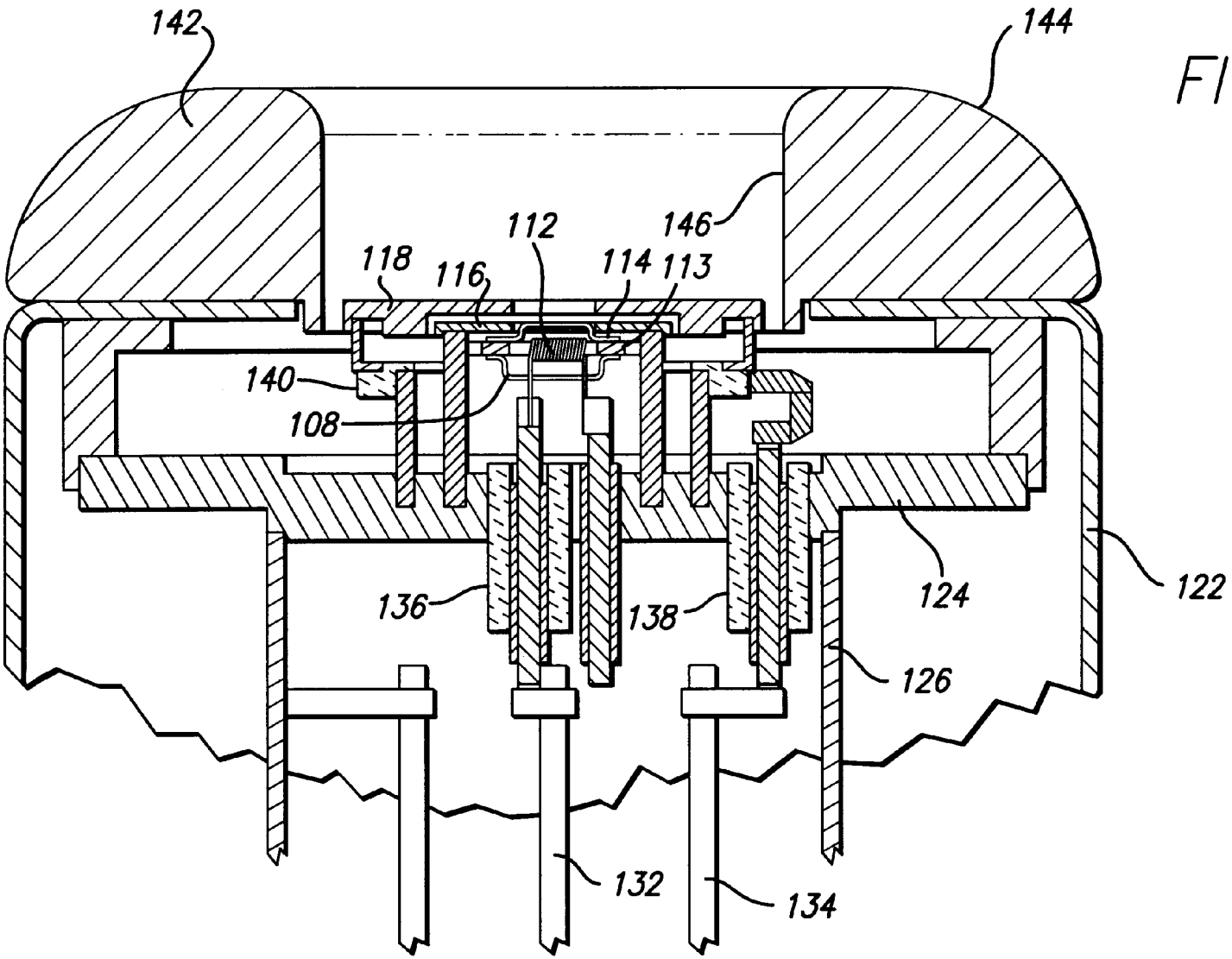
FIG. 10 is a side sectional view of an embodiment of the electron gun in accordance with the present invention.
Figure 11:
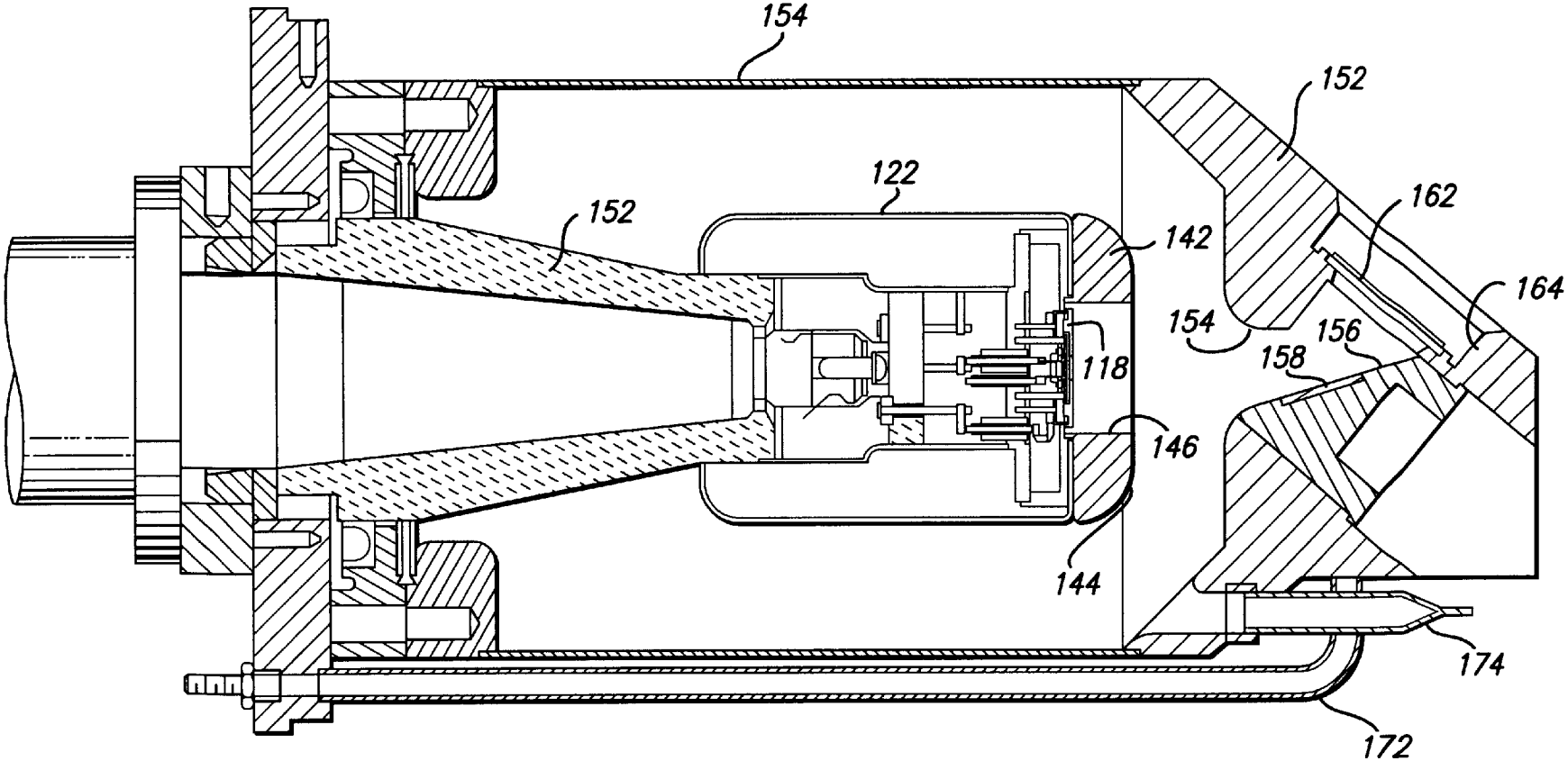
FIG. 11 is a side sectional view of an embodiment of the x-ray tube of the present invention.

Referring now to FIGS. 10 and 11, an embodiment of an x-ray tube constructed in accordance with the teachings of the present invention is illustrated. FIG. 10 illustrates an enlarged view of the cathode assembly of the x-ray tube. As in the embodiment of FIG. 5, the cathode assembly comprises a helically coiled filamentary wire 112 disposed within an oven region defined by shell halves 108, 114 coupled to opposite sides of a support ring 113. The forward facing one of the shell halves 114 provides a circular emitting surface comprised of thoriated tungsten or other set of electron emissive materials. An edge electrode 116 having an annular shape is disposed concentrically around and spaced from the emitting surface, and an annular focus electrode 142 is disposed concentrically around and spaced from the edge electrode. The focus electrode 142 has a convex, dome-shaped outer surface 144 and a constant diameter bore 146 extending concentrically with the central axis of the emitting surface. A housing 122 substantially encloses the outer portion of the cathode assembly.

An aperture grid 118 is disposed concentrically between the edge electrode 116 and the focus electrode 142. The aperture grid 118 is also annular shaped and has a central opening through which the emitting surface 114 is exposed. The emitting surface 114, the edge electrode 116, and the focus electrode 142 are commonly coupled to the same negative electric potential, and the aperture grid 118 is coupled to a voltage which is positive, negative, or equal to these other cathode elements. As in the embodiment of FIG. 1, the voltage of the aperture grid 118 alters the focusing characteristics of the cathode assembly in order to change the diameter of the electron beam produced at the emitting surface 114. An electrical lead 132 is coupled to one terminal of the filamentary wire 112, with the other terminal of the filamentary wire coupled to a conductive support plate 124 of the cathode assembly. Cylindrical isolator 136 electrically separates the remaining cathode assembly from where electrical lead 132 couples to filamentary wire 112. A voltage potential $V_H$ applied across the filamentary wire 112 causes heating of the emitter surface 114 enabling thermionic emission of electrons from the emitting surface 114. Application of a highly negative voltage potential between the cathode assembly and the anode assembly produces a generally circular electron beam at the plane of the target. A separate electrical lead 134 provides voltage to the aperture grid 118. A separate cylindrical isolator 138 electrically separates electrical lead 134 leading to aperture grid 118 from the remaining cathode assembly. Isolator ring 140 provides further electrical separation between aperture grid 118 and the remaining cathode assembly. Cylindrical isolators 136, 138 and isolator ring 140 may be comprised of a thermally conductive, electrically insulating material such as alumina ceramic.

In FIG. 11, a side sectional view of the entire x-ray tube is provided. The cathode assembly (described above with respect to FIG. 10) extends from an insulator post 152 that is axially disposed within the x-ray tube. An external housing 154 is disposed radially outward from the cathode assembly, and couples the distal end of the x-ray tube that includes the anode assembly to the proximal end of the x-ray tube that permits the device to be mounted to another structure (not shown). The anode assembly is spaced from the cathode assembly, and includes an annular portion 152 and a target portion 156. The annular portion 152 includes an opening 154 that extends along the central axis of the cathode assembly. The target portion 156 comprises a target surface 158 that is disposed at a 157.5° angle with respect to the central axis, and which is not symmetrical with the central axis. The target surface 158 is comprised of an x-ray emissive material, such as tungsten. A conically shaped opening 164 is provided between the annular portion 152 and the target portion 156 which provides an output passage for x-rays generated within the device. A window 162 crosses the conically shaped opening 164 to maintain a vacuum seal within the device. The window 162 may be comprised of beryllium or similar materials selected to permit transmission of x-rays therethrough.

As described above, a highly negative voltage is applied to the cathode assembly with respect to the anode assembly to draw a beam of electrons from the emitting surface 114 toward the anode assembly. The electron beam passes through the opening 154 of the annular portion of the anode 152, and impinges upon the target surface 158 to produce x-rays. The x-rays transmit in a generally conical path through the window 162 to form an imaging spot on the target. The voltage provided to the aperture grid 118 causes the electron beam to diverge or compress slightly as the electron beam leaves the emitting surface 114. Accordingly, the diameter of the electron beam may be controlled by altering the voltage of the aperture grid to change the diameter of the beam at the point of impact on the target surface 158. By varying the focusing of the electron beam, the imaging spot size provided by the x-ray device increases as the diameter of the electron beam striking the target surface 158 increases, and decreases as the diameter of the electron beam decreases.

Having thus described a preferred embodiment of an x-ray tube having variable imaging spot size, it should be apparent to those skilled in the art that certain advantages of the within system have been achieved. It should also be appreciated that various modifications, adaptations, and alternative embodiments thereof may be made within the scope and spirit of the present invention. The invention is further defined by the following claims.

What is claimed is:

1. An x-ray tube, comprising:

a cathode having an electron emitting surface providing an electron beam that travels substantially along an axis of symmetry of said electron emitting surface;

an anode spaced from said cathode and having a target surface disposed at an oblique angle with respect to said axis of symmetry, said target surface providing x-rays in response to impingement of said electron beam thereon, said x-rays being directed outwardly of said x-ray tube to provide an x-ray imaging spot;

at least one aperture grid having a central aperture disposed in a plane perpendicular to said axis of symmetry between said cathode and said anode permitting said electron beam to pass therethrough, said aperture grid further having a variable positive voltage applied uniformly thereto with respect to said cathode, wherein a diameter of said electron beam varies in response to said variable positive voltage;

whereby, selective variation of said electron beam diameter results in a corresponding variation in size of said x-ray imaging spot.

2. The x-ray tube of claim 1, further comprising an x-ray transparent window providing a vacuum seal of said x-ray tube with said x-rays being substantially transmitted therethrough.

3. The x-ray tube of claim 1, wherein said cathode is adapted to provide temperature limited operation.

4. The x-ray tube of claim 1, wherein said target surface is comprised of tungsten material.

5. The x-ray tube of claim 1, further comprising means for altering a position of said electron beam to displace said electron beam with respect to said axis of symmetry, thereby altering a point of impingement of said electron beam on said target surface.

6. The x-ray tube of claim 5, wherein said altering means further comprises at least one magnetic polepiece disposed in a direction perpendicular to said axis of symmetry, and means for applying a magnetic field to said at least one polepiece so that said magnetic field crosses through said electron beam.

7. The x-ray tube of claim 1, wherein said cathode further comprises an enclosed oven having an internal energy source and an emitting surface adapted to receive energy from said internal energy source.

8. The x-ray tube of claim 7, wherein said emitting surface is cup shaped.

9. The x-ray tube of claim 1, wherein said electron emitting surface is comprised of a filamentary wire, said filamentary wire disposed such that it occupies a substantially symmetrical space within said cathode.

10. The x-ray tube of claim 9, further comprising a voltage potential applied to said filamentary wire in order to cause thermionic emission from said filamentary wire.

11. The x-ray tube of claim 1, further comprising means for exciting said electron emitting surface in order to cause thermionic emission from said electron emitting surface.

12. An x-ray tube, comprising:

a cathode having an electron emitting surface providing an electron beam that travels substantially along an axis of symmetry of said electron emitting surface;

an anode spaced from said cathode and having a target surface disposed at an oblique angle with respect to said axis of symmetry, said target surface providing x-rays in response to impingement of said electron beam thereon, said x-rays being directed outwardly of said x-ray tube to provide an x-ray imaging spot;

at least one aperture grid disposed between said cathode and said anode, said aperture grid having a central aperture permitting said electron beam to pass therethrough, said aperture grid further having a variable voltage applied thereto with respect to said cathode, wherein a diameter of said electron beam varies in response to said variable voltage;

whereby, selective variation of said electron beam diameter results in a corresponding variation in size of said x-ray imaging spot, and wherein said oblique angle further comprises an approximately 157.5° angle referenced to the axis of symmetry of the impinging electron beam.

13. An x-ray tube, comprising:

a cathode having an electron emitting surface providing an electron beam that travels substantially along an axis of symmetry of said electron emitting surface;

an anode spaced from said cathode and having a target surface disposed at an oblique angle with respect to said axis of symmetry, said target surface providing x-rays in response to impingement of said electron beam thereon, said x-rays being directed outwardly of said x-ray tube to provide an x-ray imaging spot;

at least one aperture grid disposed between said cathode and said anode, said aperture grid having a central aperture permitting said electron beam to pass therethrough, said aperture grid further having a variable voltage applied thereto with respect to said cathode, wherein a diameter of said electron beam varies in response to said variable voltage; and means for altering a position of said electron beam to displace said electron beam with respect to said axis of symmetry, thereby altering a point of impingement of said electron beam on said target surface;

whereby, selective variation of said electron beam diameter results in a corresponding variation in size of said x-ray imaging spot, and wherein said altering means is disposed in said anode.

14. An x-ray tube, comprising:

a cathode having an electron emitting surface providing an electron beam that travels substantially along an axis of symmetry of said electron emitting surface;

an anode spaced from said cathode and having a target surface disposed at an oblique angle with respect to said axis of symmetry, said target surface providing x-rays in response to impingement of said electron beam thereon, said x-rays being directed outwardly of said x-ray tube to provide an x-ray imaging spot;

at least one aperture grid disposed between said cathode and said anode, said aperture grid having a central aperture permitting said electron beam to pass therethrough, said aperture grid further having a variable voltage applied thereto with respect to said cathode, wherein a diameter of said electron beam varies in response to said variable voltage;

means for altering a position of said electron beam to displace said electron beam with respect to said axis of symmetry, thereby altering a point of impingement of said electron beam on said target surface, wherein said altering means further comprises at least one magnetic polepiece disposed in a direction perpendicular to said axis of symmetry, and means for applying a magnetic field to said at least one polepiece so that said magnetic field crosses through said electron beam;

whereby, selective variation of said electron beam diameter results in a corresponding variation in size of said x-ray imaging spot, and wherein said at least one magnetic polepiece consists of a pair of crossed polepieces, said pair of crossed polepieces are disposed in said anode.

15. An x-ray tube, comprising:

a cathode having an electron emitting surface providing an electron beam that travels substantially along an axis of symmetry of said electron emitting surface, wherein said cathode further comprises a filamentary wire heater disposed within an oven region behind said electron emitting surface, said filamentary wire heater used to cause thermionic emission from said electron emitting surface;

an anode spaced from said cathode and having a target surface disposed at an oblique angle with respect to said axis of symmetry, said target surface providing x-rays in response to impingement of said electron beam thereon, said x-rays being directed outwardly of said x-ray tube to provide an x-ray imaging spot;

at least one aperture grid having a central aperture disposed in a plane perpendicular to said axis of symmetry between said cathode and said anode permitting said electron beam to pass therethrough, said aperture grid further having a variable voltage applied uniformly thereto with respect to said cathode, wherein a diameter of said electron beam varies in response to said variable voltage while maintaining generally uniform beam current density across a cross-section of said electron beam;

whereby, selective variation of said electron beam diameter results in a corresponding variation in size of said x-ray imaging spot.

16. The x-ray tube of claim 15, further comprising a voltage potential applied to said filamentary wire heater so that said filamentary wire heater will radiate heat.

17. The x-ray tube of claim 15, further comprising a voltage potential applied between said filamentary wire heater and said electron emitting surface so that said filamentary wire heater will bombard said electron emitting surface with electrons in order to cause thermionic emission from said electron emitting surface.

18. An x-ray tube, comprising:

a cathode having an electron emitting surface and coupled to means for exciting said electron emitting surface in order to cause thermionic emission from said electron emitting surface and thereby provide an electron beam;

an anode spaced from said cathode and having a target surface disposed at an oblique angle with respect to said electron beam, said target surface providing x-rays in response to impingement of said electron beam thereon, said x-rays being directed outwardly of said x-ray tube to provide an x-ray imaging spot; and means for adjusting the spot size and x-ray intensity of said x-ray tube by varying the diameter of said electron beam, said adjusting means including an aperture grid disposed in a plane perpendicular to an axis of symmetry of said electron emitting surface between said cathode and said anode so that said electron beam passes substantially through said aperture grid, said aperture grid applying a uniform variable electric field that is positive with respect to said cathode.

19. The x-ray tube of claim 18, further comprising an x-ray transparent window providing a vacuum seal of said x-ray tube with said x-rays being substantially transmitted therethrough.

20. The x-ray tube of claim 18, wherein said cathode is adapted to provide temperature limited operation.

21. The x-ray tube of claim 18, wherein said target surface is comprised of tungsten material.

22. The x-ray tube of claim 18, further comprising means for altering a position of said electron beam to displace said electron beam with respect to an axis of symmetry, thereby altering a point of impingement of said electron beam on said target surface.

23. An x-ray tube, comprising:

a cathode having an electron emitting surface and coupled to means for exciting said electron emitting surface in order to cause thermionic emission from said electron emitting surface and thereby provide an electron beam;

an anode spaced from said cathode and having a target surface disposed at an obligue angle with respect to said electron beam, said target surface providing x-rays in response to impingement of said electron beam thereon, said x-rays being directed outwardly of said x-ray tube to provide an x-ray imaging spot; and means for adjusting the spot size and x-ray intensity of said x-ray tube by varying the diameter of said electron beam, said adjusting means being disposed between said cathode and said anode, wherein said oblique angle further comprises an approximately 157.5° angle referenced to an axis of symmetry of the impinging electron beam.

* * * * *